United States Patent [19]

Offutt

[11] Patent Number: 4,595,199

[45] Date of Patent: Jun. 17, 1986

[54] BASKETBALL GAME APPARATUS

[75] Inventor: James C. Offutt, Peoria, Ill.

[73] Assignee: Rimball, Inc., Peoria, Ill.

[21] Appl. No.: 652,312

[22] Filed: Sep. 19, 1984

[51] Int. Cl.[4] ..... A63B 63/08

[52] U.S. Cl. ..... 273/1.5 A

[58] Field of Search ..... 273/1.5 R, 1.5 A, 396, 273/399, 402

[56] References Cited

U.S. PATENT DOCUMENTS

| | | | |
|---|---|---|---|
| D. 110,225 | 6/1938 | Schutt | D21/201 |
| D. 277,884 | 3/1985 | Offutt | D21/201 |
| 1,258,931 | 3/1918 | Newcombe | 273/402 |
| 1,765,269 | 6/1930 | Hatley | 273/1.5 A |
| 2,130,820 | 9/1938 | Trumbull | 273/1.5 R |
| 2,194,779 | 3/1940 | Albach | 273/1.5 R |
| 2,278,616 | 4/1942 | Kettering | 273/1.5 R |
| 2,545,615 | 3/1951 | Hatley | D21/200 X |
| 2,838,308 | 6/1958 | Polite | 273/1.5 R |
| 2,889,149 | 6/1959 | Williams | 273/396 |
| 3,350,097 | 10/1967 | Chevrette et al. | 273/1.5 R X |
| 3,388,909 | 6/1968 | Woods | 273/1.5 R |
| 3,421,764 | 1/1969 | Smith et al. | 273/402 |
| 3,561,762 | 2/1971 | Russell | 273/396 |
| 3,588,103 | 6/1971 | Fuller | 273/1.5 R |
| 3,602,505 | 8/1971 | Friend | 273/1.5 R |
| 3,776,550 | 12/1973 | McNabb | 273/1.5 A |
| 3,814,421 | 6/1974 | Spier, Jr. | 273/396 X |
| 3,901,506 | 8/1975 | Caveney | 273/1.5 A |
| 3,913,916 | 10/1975 | Martin, Jr. | 273/1.5 R X |
| 3,917,263 | 11/1975 | Wiley | 273/1.5 A |
| 4,286,786 | 9/1981 | Papadopoulos | 273/396 |

FOREIGN PATENT DOCUMENTS

| | | | |
|---|---|---|---|
| 2228513 | 12/1974 | France | 273/396 |

OTHER PUBLICATIONS

Argo Industries Corp., "Water Fun", 3-1965.

Ideal Pool & Inflatables Catalog 1965, 3-1965, 5095-5 Basketball Game.

*Primary Examiner*—Paul E. Shapiro

*Attorney, Agent, or Firm*—Allegretti, Newitt, Witcoff & McAndrews, Ltd.

[57] ABSTRACT

A basketball goal apparatus having a hoop and net goal supported in a plane parallel to the floor by four legs depending from the goal. Four net standards are secured to respective legs at a point spaced below the plane of the goal and extend upwardly at an angle through said plane to a point spaced above the goal for supporting a netting. The netting is disposed in three orthogonal side planes defined by the ends of the standards and surround the rim. A ball return platform positioned beneath the goal is tilted with respect to normal for returning the ball to the player.

2 Claims, 4 Drawing Figures

BASKETBALL GAME APPARATUS

BACKGROUND OF THE INVENTION

The invention relates to a basketball goal apparatus for use to play floor basketball games, and more particularly relates to a basketball goal apparatus having a ball return feature permitting practice or play by one person.

Heretofore applicant devised a game ball apparatus for free standing on a basketball floor or other hard floor surface. The goal apparatus does not include a bank board and thus permits players to shoot a basketball into the goal from a position anywhere about the 360° circumference of the rim. This goal structure includes a circular rim disposed in a plane parallel to the floor and supported above the floor by four legs angling outward with respect to the rim. The legs are secured to a circular standard serving as a base for the goal apparatus.

It has been found that a single player using such a goal structure must rebound the ball anywhere in the 360° area about the rim, since there is no bank board on the goal apparatus. It would be highly desirable, particularly for practicing by a single player, to provide a ball return feature to the goal structure.

It is therefore an object of the present invention to provide a free standing, basketball goal having a ball return structure.

It is yet another object of the present invention to provide a ball return structure to a free standing goal apparatus which structure will not overturn the goal apparatus when impacted by the basketball.

SUMMARY OF THE INVENTION

These and other objects of the invention are achieved in a basketball goal apparatus having a hoop and net goal supported in a plane parallel to the floor. Ball containment structure positioned on three sides of the rim contain the ball for return at the fourth side. A guiding structure placed beneath the rim serves to move the basketball in the direction of the fourth side and back to the player.

In a preferred embodiment, the ball containment structure is secured to the goal in a manner to leave the hoop unobstructed. The symmetry and disposition of the components of the preferred containment structure, prevents the goal from being easily knocked over during play.

DESCRIPTION OF THE PREFERRED EMBODIMENT

Figure 1:
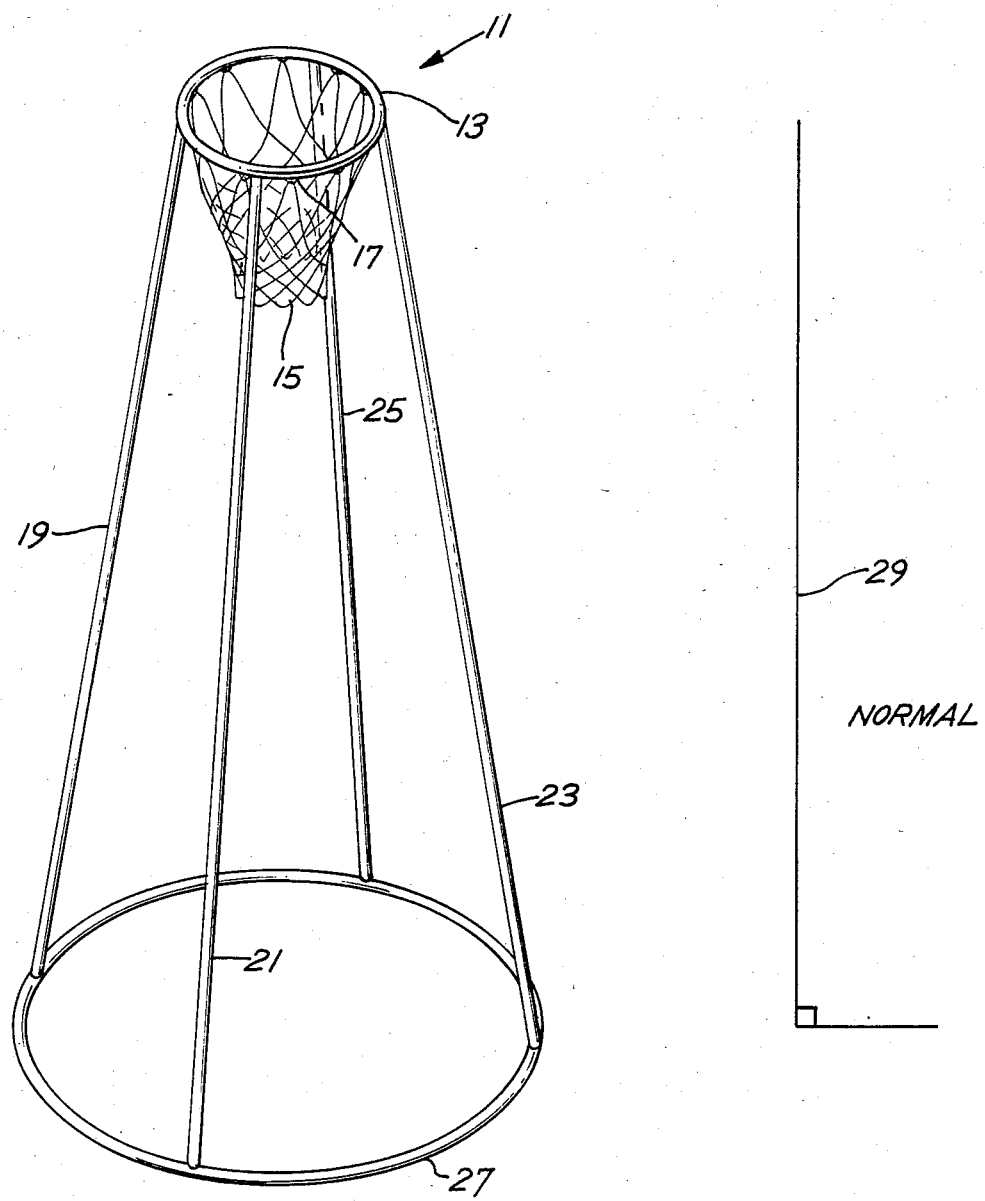
Fig. 1 PRIOR ART
FIG. 1 is a prior art basketball goal apparatus.

Referring to FIG. 1, a prior art basketball goal apparatus includes a hoop and net goal 11 comprising a rim 13 and a basketball net 15. The net is secured to conventional rim hooks 17 equally spaced around the circumference on the underside of rim 13.

Rim 13 is disposed in a plane substantially parallel to the floor by four cylindrical supporting legs 19, 21, 23, 25. A circular supporting ring 27 connects the bottom ends of each of legs 19–25 for maintaining the legs at a particular angle with respect to the normal 29 and for providing a base for resting on the floor. The normal is defined as a line perpendicular to the plane of the floor.

Figure 2:
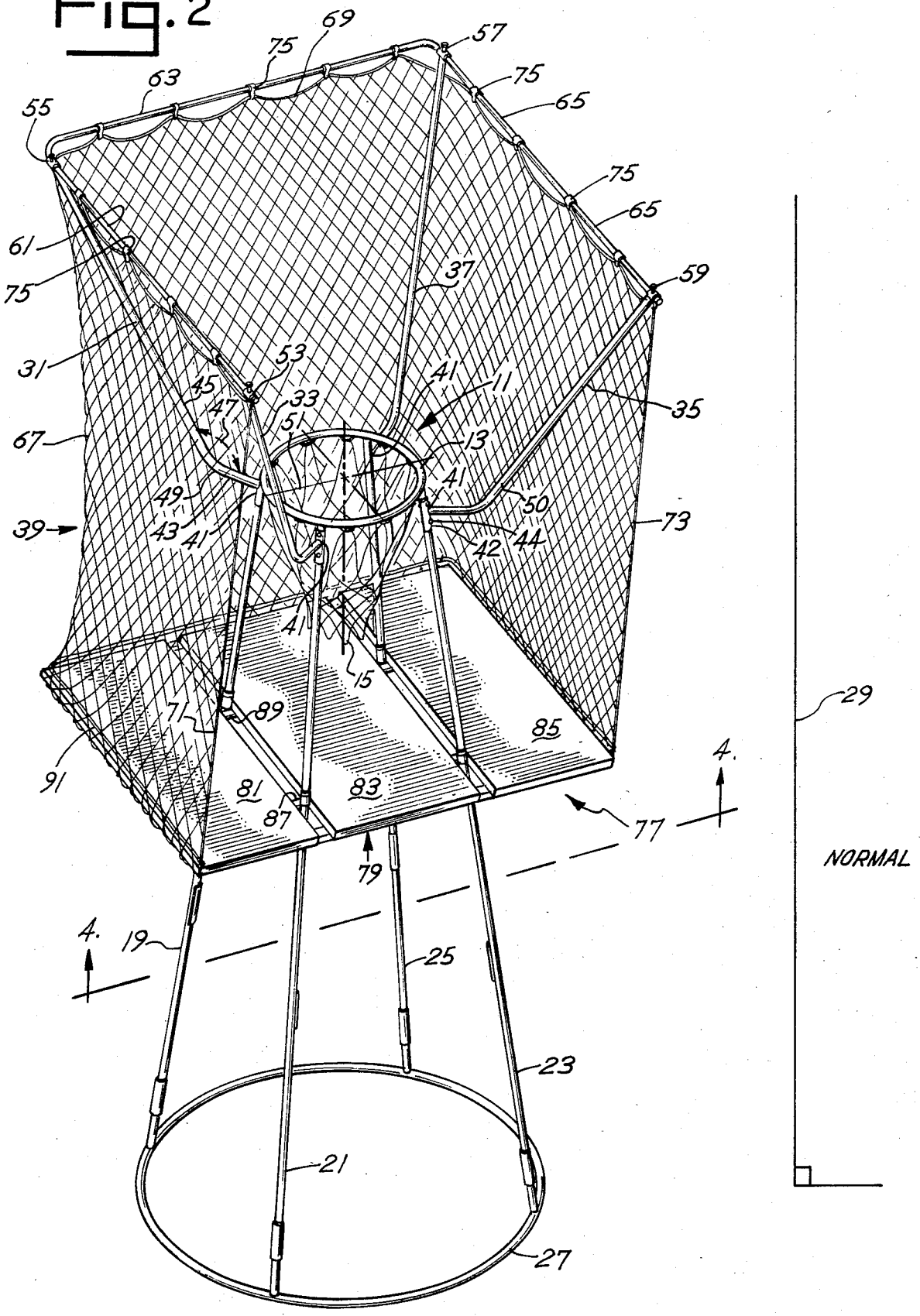
FIG. 2 is a perspective view of a preferred embodiment of the basketball apparatus of the present invention.
Figure 3:
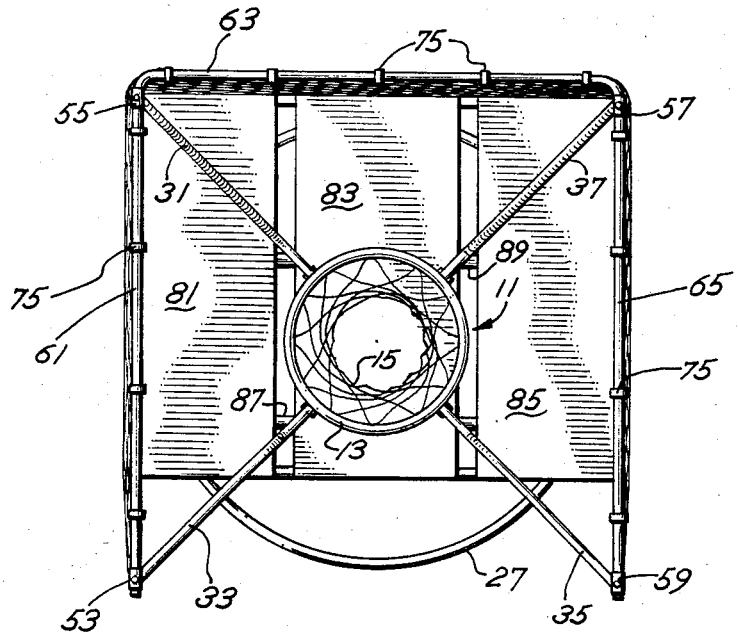
FIG. 3 is a top view of the basketball apparatus of FIG. 2.

Referring to FIG. 2, a preferred embodiment of the basketball apparatus of the present invention includes a ball containment and ball return feature. The apparatus of FIG. 2 includes the same components of the apparatus of FIG. 1, identified by like reference numerals.

Four standards 31, 33, 35, 37 extend upwardly from the plane of the rim for supporting a net containment structure 39 as shown. Each one of the standards is secured to one of the legs 19–25 at a point 41 spaced below the plane of rim 13.

Each standard is formed to include a pair of cylindrical portions 43, 45 disposed at an obtuse angle 47 with respect to one another. The two cylindrical portions 43, 45 are preferably formed from the same tubular element which is bent at angle 47. The shorter portion 43 is connected to its respective leg and extends outwardly and slightly upwardly to a point 49 where the two portions 43, 45 merge. From point 49, the longer portion 45 extends upwardly at an angle to normal 29 and passes through the plane 51 of the rim at a point 50. Point 50 is laterally spaced from rim 13 by at least half the diameter of the basketball to be used with the goal apparatus.

The portion 43 of each standard is secured to its respective leg by a bracket 42. Bracket 42 includes is a concave member that partially wraps around the outer cylindrical surface of legs 19–25. The concave portion includes a pair of screw holes for receiving screws 44 to bolt the concave portion tight against the leg. The portion 43 of the standard is welded directly to the bracket 42.

The portion 45 of each standard extends to an end 53, 55, 57, 59 located approximately three feet above the plane of rim 13. A plurality of side rod members 61, 63, 65 connects respective ends 53, 55 and 55, 57 and 57, 59 as shown. The three rod members 61, 63, 65 may be formed from a single rod member bent at ends 55, 57, as understood. The rod members may be secured to the ends 53–59 in any suitable fashion, as for example, screws and brackets.

Rod members 61, 63, 65 serve to stabilize the upper ends of rod portions 31, 33, 35, 37 in the event of impact by the basketball, as well as for supporting a net 67. As shown in FIG. 2, net 67 surrounds the rim and is disposed in three orthogonal side planes defined by rod members 61, 63, 65 and which side planes are parallel to normal 29.

Net 67 is bound by a chord 69 at the upper edge of the net and bound by chords 71, 73 at the side edges of the net. Upper chord 69 is secured in place by a plurality of slidable hook members 75 positioned on each of the rod members.

As shown in FIG. 2, the netting extends below the bottom of rim 13 and net 15. Thus, the net surrounds three sides of rim 13 leaving an opened fourth side as shown. As the ball strikes the rim 13, it bounces into the net 67 or against standards 31–37 which contain the ball within the three planar sides formed by net 67.

A ball return structure generally indicated by numeral 77, serves to guide the basketball in a direction towards the fourth open side of the apparatus. The return structure includes a planar platform 79 formed of three planar boards 81, 83, 85 positioned beneath the bottom of net 15 for guiding the basketball towards the open side. The three planar boards 81–85 are juxtaposed in a plane with a pair of legs 19, 21 and 23, 25 passing between the boards. The three boards are tilted downwardly relative to the open side of the apparatus for guiding the ball thereto.

Figure 4:
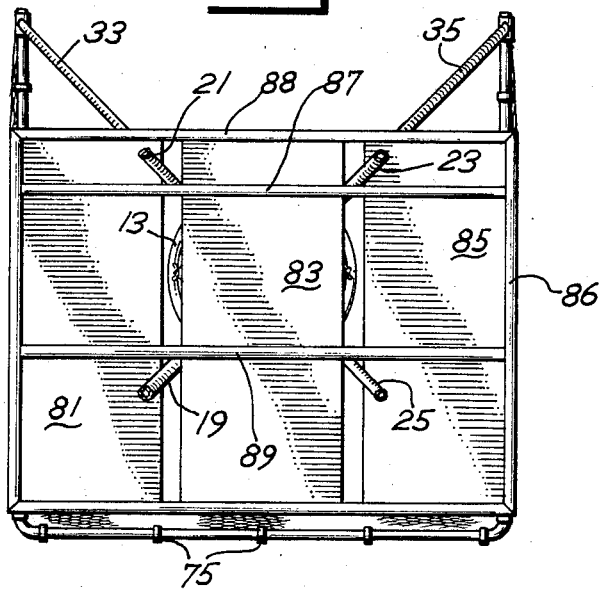
FIG. 4 is an underside view of the return structure of the apparatus of FIG. 2.

As shown in FIG. 4, a frame of tubular pipe 86 circumscribes the bottom outside edge of the three planar boards for support. Also, a pair of underside support members 87, 89 are used to support the three planar boards relative to one another. The platform 79 formed by the three boards is secured to legs 19–25 by conventional means, for example, screws and brackets. Concave brackets, similar to bracket 42, may be used to secure the legs to the two support members 87, 89; such a bracket may have a support arm welded thereto for screw securement to a support member 87, 89.

In play, the player stands facing the open side of the apparatus to shoot the basketball towards the rim 13. Should the basketbal pass through rim 13 and net 15, the ball will bounce against the center return board 83 and be directed outwardly through the open area back to the player. Should the ball bounce against rim 13 and onto net 67, the basketball will be channeled downwards towards the return platform 79 for directing the basketball back to the player.

Because standards 31–37 are secured to the legs below the rim and are laterally spaced by portion 43 prior to extending through the plane of the rim, the rim area remains unobstructed. This permits the ball to bounce on the top of the rim and then fall into the basketball net 15 without interference.

Referring again to FIG. 2, chords 71, 73 of net 67 may be secured, respectively, to boards 81, 85. A plurality of nylon loops (not shown) may be secured to the bottom of net 67 where the net meets platform 79, for looping onto steel frame 86 beneath the boards in order to hold the bottom of the net to the return platform. The steel frame 86 may be formed in two U-shaped, detachable parts for permitting threading of the nylon loops onto the frame. Also, a separate rectangular netting (4'×8') may be secured to the front pipe 88 of frame 86 and extended outwardly and downwardly toward the ground for providing further ball return to the player, who stands facing the extended separate netting (not shown).

As will suggest itself, the components of the goal apparatus may be secured together by conventional means, as for example, screws and bolts, weldments, brackets, etc.

It is to be understood, of course, that the foregoing describes a preferred embodiment of the present invention and that modifications may be made therein without departing from the spirit or scope of the present invention as set forth in the appended claims.

What is claimed:

1. A basketball goal apparatus for free standing positioning on a floor for use with a basketball comprising:

a hoop and net goal including a circular rim of a size for receiving the basketball, said rim being disposed in a plane substantially parallel to the floor;

four legs attached to and depending from said rim at an angle with respect to normal, for supporting said goal a spaced distance above the floor;

ball containment means including:

(i) four standards, each said standard secured to a said leg at a point spaced below the plane of said rim and extending upward at an angle to said normal and passing through said plane at a point laterally spaced from said rim by at least half the diameter of the basketball, said standard extending to a point approximately three feet above said plane;

(ii) net means supported by said standards, said net means including netting substantially disposed in three orthogonal side planes defined by the ends of said standards and disposed surrounding said rim, said netting extending above and below said rim plane in each of said side planes; and ball return means comprising a planar platform, said platform including three planar boards juxtaposed in a plane with a pair of legs passing between a pair of said boards, said three planar boards forming a return plane and being tilted with respect to normal.

2. A basketball goal apparatus according to claim 1 wherein each of said standards is formed from a pair of rod members, one of said rod members extending laterally from its respective leg below the plane of the rim and the other of said rod members extending upwardly from said one rod member and at an obtuse angle therewith.

* * * * *